United States Patent [19]

Göpel

[11] 4,235,827

[45] Nov. 25, 1980

[54] FLOAT-TYPE CARBURETOR

[76] Inventor: Theo Göpel, Frauenstädtstr. 13, D-8000 München 40, Fed. Rep. of Germany

[21] Appl. No.: 10,010

[22] Filed: Feb. 7, 1979

[30] Foreign Application Priority Data

Feb. 24, 1978 [DE] Fed. Rep. of Germany ..... 2808126

[51] Int. Cl.[3] ..... F02M 5/14

[52] U.S. Cl. ..... 261/67; 261/70; 261/41 D; 137/423

[58] Field of Search ..... 261/70, 67, 41 D; 137/423

[56] References Cited

U.S. PATENT DOCUMENTS

| | | | |
|---|---|---|---|
| 1,313,925 | 8/1919 | Stewart | 261/70 |
| 1,746,302 | 2/1930 | Bronander | 261/70 |
| 1,911,838 | 5/1933 | Mathieu | 261/70 |
| 1,933,360 | 10/1933 | Barbarou | 261/70 |
| 2,258,271 | 10/1941 | Walter | 261/70 |
| 2,782,797 | 2/1957 | Hintermayr | 261/70 |
| 2,855,949 | 10/1958 | Sterner et al. | 261/70 |
| 3,120,242 | 2/1964 | Schneider | 261/70 |
| 3,495,809 | 2/1970 | Elam | 261/67 |
| 3,593,740 | 7/1971 | Harrison et al. | 261/70 |
| 3,654,955 | 4/1972 | Roach et al. | 137/423 |

FOREIGN PATENT DOCUMENTS 2524772 12/1976 Fed. Rep. of Germany .

OTHER PUBLICATIONS

Hutte IIa (1954), p. 774, Fig. 79, Ernst & Sohn, Berlin, Germany.

*Primary Examiner*—Tim R. Miles

*Attorney, Agent, or Firm*—Balogh, Osann, Kramer, Dvorak, Genova & Traub

[57] ABSTRACT

This invention discloses a carburetor comprising a gasoline conduit to the float housing and a main nozzle disposed in the fuel passage, the spray nozzle being arranged in the mixing chamber in the region of the air funnel of the intake pipe, wherein a float needle is provided for idling and a further float needle for operation, the two needles closing at different levels.

6 Claims, 3 Drawing Figures

FLOAT-TYPE CARBURETOR

This invention relates to a carburetor comprising a gasoline conduit to the float housing, and a main nozzle disposed in the fuel passage, the spray nozzle being arranged in the mixing chamber in the region of the air funnel of the intake passage.

In gasoline-driven internal combustion engines float-type carburetors have established themselves, the so-called "downdraft" or inclined draft carburetors, the air in the induction passage being guided vertically from above downwardly or horizontally.

In city traffic in particular, where the gas pedal is frequently actuated, gasoline consumption is high. This is due inter alia, and this is where the knowledge on which the invention is based plays a part, to the fact that when the butterfly valve is closed although the suction air is throttled due to the inertia or impulse a relatively small amount of excess gasoline flows from the spray nozzle into the air funnel of the carburetor and is sucked in by the engine. In city traffic the butterfly valve is frequently opened and closed. This effect adds up and the result is a considerably increased gasoline consumption as well as fouling of spark-plugs and interior of the cylinders due to incomplete combustion because the engine is supplied with too little air and too much gasoline.

The objective of the present invention is to reduce the after-flow of fuel after closure of the butterfly valve.

According to the invention this objective is surprisingly achieved in that in a carburetor of the type mentioned at the beginning a float needle is provided for idling and a further float needle for operation.

Preferably, the two float needles close at different levels.

It is particularly favourable for the operating level to lie about 2–4 mm below the idling level.

As hitherto usual for the one float needle, the two float needles are accommodated according to the present invention in the cover of the housing.

It is expedient for at least the float needle valve for the operating level to close against the pressure of a weak spring.

According to a preferred embodiment the throughflow of the idling float needle valve is so dimensioned that the latter is supplied with 1.5 to 2 times the amount of fuel necessary for idling.

Of course, a great variety of different constructional solutions are possible.

Thus, according to a preferred embodiment two floats may be provided in their own interconnected housings and close the needle valves at the different levels. This has the advantage that it is not left to a single float to successively carry out two closure operations. With separate floats it is possible to arrange the float needle valves at particularly favourable positions, for example centrally above the float.

As far as possible use is made of components known per se such as the extremely complicated very accurately operating known float needles of conventional carburetors. With respect to the known jet gages, which are defined according to the throughflow amount, for the idling nozzle the jet gage 15–20 is chosen and for operation the jet gage 120 is selected.

The early closure of the valve for operation and the consequently very much slower after-flow of the gasoline via the idling float needle prevents the fuel from being further injected under the considerable pressure by the gasoline pump into the float chamber, due also to the inertia of the float, and the fuel level rising for an instant above the level desired as regards the adjustment. Thus, the overall result is that the fuel consumption is reduced. A "bouncing" of the float is also substantially avoided. No negative effect on the other engine aggregates or carburetor is to be expected.

It is particularly favourable to combine the suggestion according to the invention with earlier proposals (cf. patent application No. 25 24 772.7), steadying or turbulence chambers being fitted into the induction passage of the engine between the latter and the carburetor onto the induction conduit and at the entry edge into the turbulence chamber a sheet metal plate extending obliquely into the induction passage. This again swirls the fuel. There is a cumulative effect of these two features on the gasoline saving.

Examples of embodiment of the invention will now be explained in detail with reference to the enclosed drawings, that is embodiments with two float needle valves and a single float and with two floats.

The expert will be familiar with the illustration technique of all three Figures and consequently will readily be able to realise the constructions.

Figure 1:
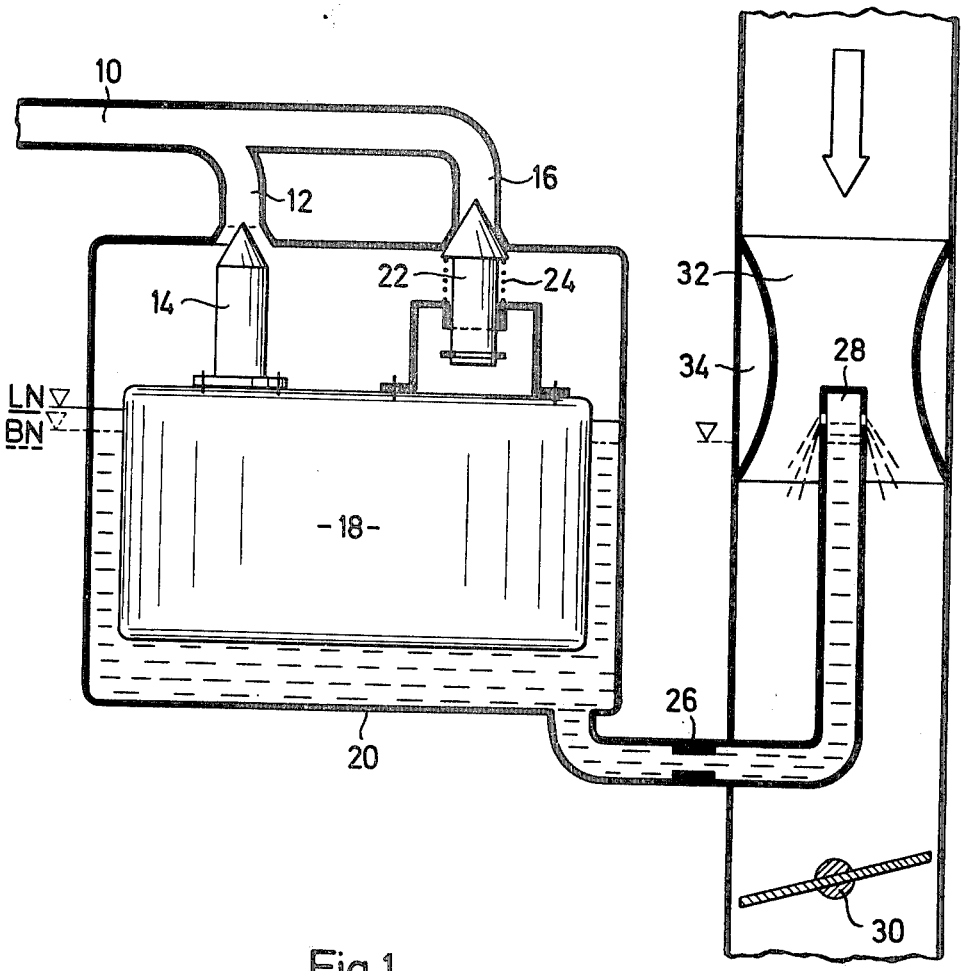
FIG. 1 is a highly diagrammatic illustration.

The illustration of FIG. 1 is for example to be regarded as purely diagrammatic. The illustration is however on the same basis as that in Hütte II a (1954), page 774, FIG. 79. The illustration is diagrammatic because for simplicity the float needle valves are shown on the float and the valve seat in the float housing cover. In fact, as in the known construction the float needle valves are of course disposed in the cover of the float housing and are acted upon by the resilient retaining band of the float.

The fuel conduit 10 of FIG. 1 divides into two branch conduits 12 to the float needle 14 and 16 to the float needle 22 for idling and operation. The float needle 22 for operation always closes earlier than that for idling needle 14 and is biased in the direction of closure of the float valve needle 22 by a spring 24, connected or wrapped around the body of float needle 22. The float 18 acts on the float needles 14 and 22 (actually disposed in the float housing cover) in such a manner that at the level BN (operating level) the needle 22 already closes and at the level LN the float needle for idling closes. It should be pointed out that the regulation at the usual level corresponds to the regulation of the idling level in the subject of the application. The dimensioning is such that the float valve for idling is supplied with 1.5 to 2 times the throughflow amount of the idling consumption.

The jet gage of the nozzle for operation is made 120 and that for idling 10. In a manner known per se the fuel flows from the float housing 20 on opening of the butterfly valve 30 through the fuel passage provided with the main nozzle 26 to the spray nozzle 28. The spray nozzle 28 is disposed in usual manner in the mixing chamber 32 of the air funnel 34.

Figure 2:
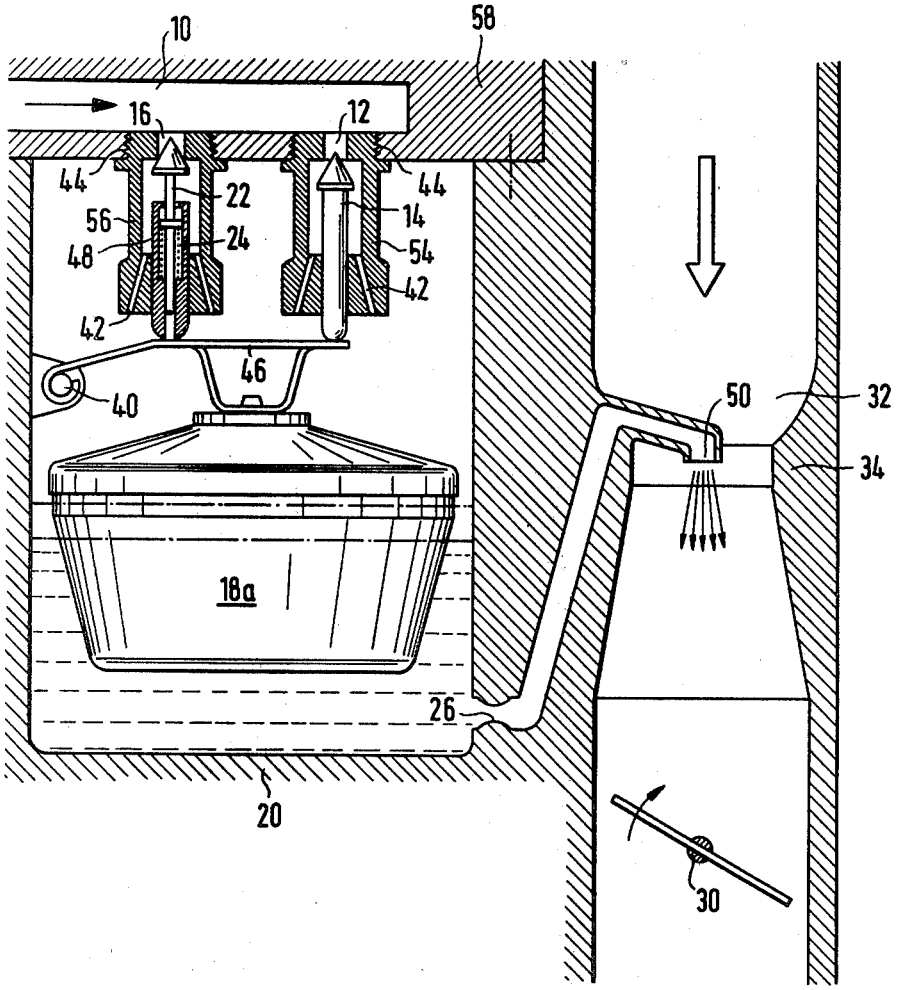
FIG. 2 is a somewhat more constructional illustration of an embodiment having one float and FIG. 3 is a somewhat more constructional illustration of an embodiment having two floats.

FIG. 2 is a somewhat more constructional illustration showing the float needles 14 and 22 mounted in the cover 58. As illustrated, the float needles are housed in inserts 54 and 56, each of which has a screw connection 44. It is however also possible to screw the inserts 54 and 56 into the cover in such a manner that their level may be adjusted by screwing. The float needle for idling is mounted without interposition of a spring on a lever or a bridge 46 of the float 18*a*, the lever or bridge being articulately mounted at a joint 40. The float needle 22 for part-load or full-load is positively guided or moved in a sleeve 48 against the action of a spring 24 connected to or wrapped around the body of float needle 22. This is thus a two-part telescopic float needle or float needle push or moving member which acts directly on one side on float needle 22 and directly on the other side on the float or its bridge 46. Thus, even on lowering of the float 18*a*, because of the action of the collar (not designated) provided on the shank of the float needle said needle 22 is pressed initially into the closure position and opens only when by pressure on the gas pedal the air in the induction passage withdraws more gasoline from the nozzle 50 constructed in a manner known per se. At 42 small drain bores are illustrated.

Figure 3:
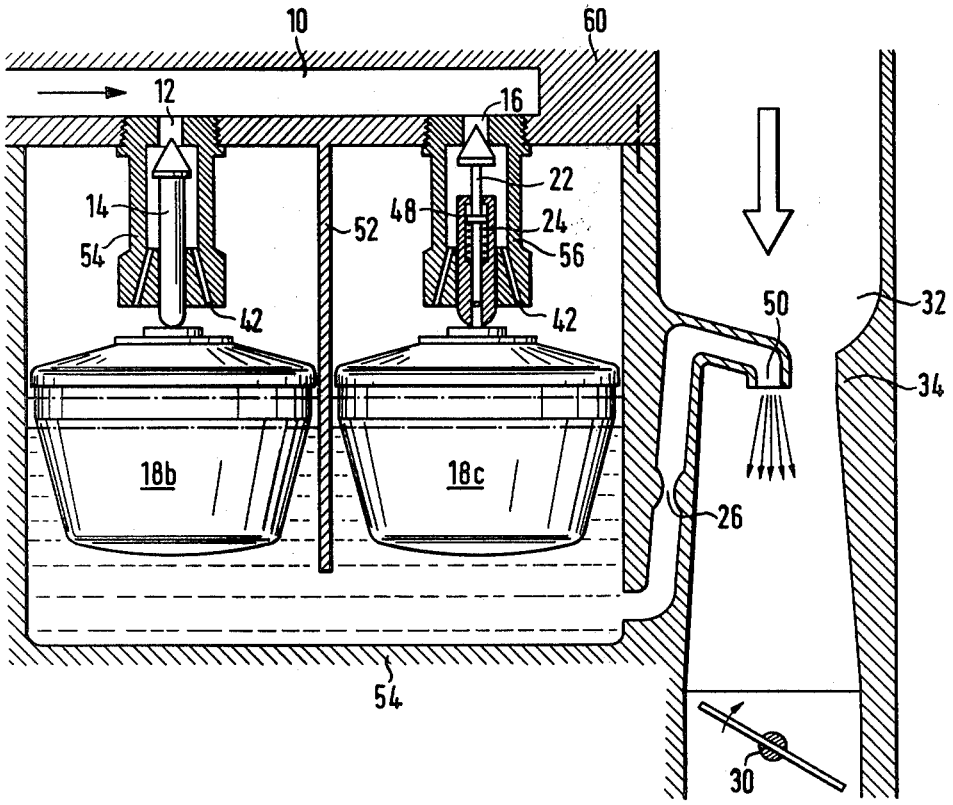

The embodiment of FIG. 3 is one in which two floats 18*b* and 18*c* are provided in their own interconnected housings. These housings are formed by dividing the common housing 54 by a partition 52 which does not extend to the bottom of the housing 54 and thus leaves a considerable connecting space. The floats in this embodiment float freely. One float 18*b* acts on the nozzle 14 for idling and the other float 18*c* acts via the telescopic construction of the push member described with respect to FIG. 2 on the float needle 22. The same level is always ensured due to the communication between the housings. It is obvious that due to the constructional form the float needles close at different levels. It is particularly favourable to associate only one closure operation with each of the floats 18*b* respectively 18*c*. The float needle valves are arranged at particularly advantageous positions, i.e., centrally over every float. The fuel conduit 10, as well as the cover 60, only schematically have been shown. The inserts 54 and 56 may be fastened or screwed into the cover 60 in a manner such that their level may be adjusted.

What I claim is:

1. In a carburetor of the type including a float, a float housing, a gasoline conduit leading and connected to the float housing, a mixing chamber having an air funnel, a fuel passage connecting the float housing and the mixing chamber, a main nozzle disposed in the fuel passage, and a spray nozzle disposed in the region of the air funnel in the mixing chamber, the improvement which comprises idling valve means and operational valve means disposed in the cover of the float housing, spring means connected to said operational valve means for biasing the same in the direction of closure thereof, and means for positivley moving said operational valve means open against the bias of said spring means, after a predetermined downward movement of the float, said idling and operational valve means closing at different levels of fuel in the float housing.

2. An improved carburetor according to claim 1, wherein said different levels consist of an operating level and idling level, and said operating level is about 2–4 mm below said idling level.

3. An improved carburetor according to claim 1, wherein said idling valve means have predetermined dimensions such that they can be supplied with 1.5 to 2 times the idling fuel consumption.

4. An improved carburetor according to claim 1, wherein said moving means comprise a sleeve member for directly moving said operational valve means into opening and closing positions in response to predetermined upward and downward movement of the float.

5. An improved carburetor acording to claim 1, further comprising two floats, and the float housing being divided into two interconnected float housings, each of said floats being disposed in one of said housings, said operational valve and moving means cooperating with one of said floats, and said idling valve means cooperating with the other float, said operational and idling valve means closing at different levels in each of said housings.

6. An improved carburetor according to claim 5, wherein said floats are freely floating each in its own housing.

* * * * *